United States Patent [19]

Kutz

[11] Patent Number: 4,485,659

[45] Date of Patent: Dec. 4, 1984

[54] APPARATUS FOR ADJUSTABLY LOCKING THE MOVABLE COUNTER GRIPPING HEAD OF A SHEET OR SECTION STRETCHER

[75] Inventor: Heinrich Kutz, Neuss, Fed. Rep. of Germany

[73] Assignee: SMS Schloemann-Siemag Aktiengesellschaft, Dusseldorf, Fed. Rep. of Germany

[21] Appl. No.: 358,257

[22] Filed: Mar. 15, 1982

[30] Foreign Application Priority Data

Mar. 21, 1981 [DE] Fed. Rep. of Germany ..... 3111183

[51] Int. Cl.[3] ..... B21D 11/02; B21D 25/00

[52] U.S. Cl. ..... 72/302

[58] Field of Search ..... 72/295, 302, 301, 378; 403/368, 369, 370

[56] References Cited

U.S. PATENT DOCUMENTS

| | | | |
|---|---|---|---|
| 294,629 | 3/1884 | Jenkins | 403/369 |
| 687,864 | 12/1901 | Smyth | 403/370 |
| 1,027,129 | 5/1912 | Henry | 403/370 |
| 1,367,099 | 2/1921 | Schmidt | 72/302 |
| 2,449,507 | 9/1948 | Pope | 72/302 |
| 2,852,062 | 9/1958 | Lorant | 72/302 |
| 2,908,316 | 10/1959 | Albers | 72/302 |
| 3,038,520 | 6/1962 | Elger | 72/302 |
| 3,172,528 | 3/1965 | Smith | 72/302 |

FOREIGN PATENT DOCUMENTS

| | | | |
|---|---|---|---|
| 1040886 | 10/1958 | Fed. Rep. of Germany | 72/302 |
| 1906646 | 8/1970 | Fed. Rep. of Germany | 72/302 |
| 584154 | 1/1947 | United Kingdom | 72/302 |
| 791867 | 3/1958 | United Kingdom | 72/302 |
| 1075672 | 7/1967 | United Kingdom | 72/302 |
| 1369236 | 10/1974 | United Kingdom | 403/369 |

*Primary Examiner*—Daniel C. Crane

*Attorney, Agent, or Firm*—Holman & Stern

[57] ABSTRACT

A sheet (4) to be stretched is gripped in gripping heads (1, 2) interconnected by pressure members 3, the gripping heads being moved apart by hydraulic cylinder units. Owing to the different lengths of sheet to be stretched, one of the gripping heads—the counter gripping head (2)—is movable and may be locked to the pressure members (3) in different positions. In order to facilitate better adjustment between the pressure members and the gripping head (2) opposite sides of the pressure members (3) are provided with teeth (12, 13) removably engageable by toothed locking members (14, 15). Engagement is carried out by hydraulic cylinders operating axially-displaceable wedges (16, 17) connected to the locking members (14, 15).

10 Claims, 7 Drawing Figures

APPARATUS FOR ADJUSTABLY LOCKING THE MOVABLE COUNTER GRIPPING HEAD OF A SHEET OR SECTION STRETCHER

BACKGROUND OF THE INVENTION

1. Field of the Invention

The invention relates to a device for locking the movable counter gripping head of a sheet or section stretcher, comprising pressure elements which are provided between the counter gripping head and the stretching gripping head and which are disposed on both sides and at the level of the material to be stretched.

2. Description of the Prior Art

In sheet or section stretchers the sheet to be stretched is gripped in gripping heads which are moved away from one another by hydraulic cylinder units. Owing to the varying lengths of sheet one of the gripping heads is movable and may be locked in various positions in a positive manner with the force-transmitting elements, which may be the machine framework or special press or tie rods. Locking is effected in any position by way of nuts and spindles or in stepwise positions by way of bayonet sockets which engage in spindles constructed in a bayonet shape. The spindles are the pressure elements, which are prevented from buckling in a trouble-free manner only where the material to be stretched is short.

Solutions are also known in which the counter gripping head is locked in the pressure elements by means of pins and holes. In this case the spacing from hole to hole is relatively large, which results in increased strokes of the cylinder units. In order to reduce the effective spacing, the counter gripping head is also provided with two pins which are arranged one behind the other at a distance of 1.5×hole spacing and which may be inserted alternately, so that an effective spacing of 0.5×hole spacing is produced. On the one hand the effective spacing from position to position is still relatively large, even in the case of the latter solution, and on the other hand the device necessary for inserting and extracting the pins projects far above the level of the other components of the apparatus.

BRIEF SUMMARY OF THE INVENTION

The object of the invention is thus to provide a compact locking unit which also permits a finely graduated positioning of the counter gripping head on the pressure elements and is suitable for large lengths of material to be stretched.

In the device described above for locking the counter gripping head this object is attained according to the invention in that the top and underside of the pressure elements are provided with toothing, into which locking members, which are disposed in the counter gripping head, may be engaged and disengaged and are provided with a plurality of corresponding teeth.

By virtue of this arrangement it is possible to lock the counter gripping head, offset only by the length of one tooth in each case, to the pressure elements, whereby a very narrow displacement tolerance is obtained, provided that the stretching cylinder is designed with a correspondingly smaller stretching length.

According to a further inventive feature the locking members may be engaged and disengaged by means of axially displaceable wedges connected to the locking members by way of guides. These wedges are guided on the counter gripping heads in the vertical plane of the axis of the pressure elements and are guided with their wedge face on the locking members by way of hammer-head guides for example. In this way a compact locking unit is formed which, in addition to the fine positioning gradation, does not require any particular outlay in terms of structural height.

In a further development of the invention the wedges may be moved by hydraulic cylinders acting parallel to the axial direction of stretching, disposed on the counter gripping head and articulatedly connected to the wedges.

According to a further feature of the invention the wedges may also be moved in the axial direction of stretching by being connected by means of linking plates and levers articulated thereon to a vertical shaft which is mounted in the counter gripping head and which may be actuated, via an angle lever firmly disposed on the said vertical shaft, by means of a single hydraulic cylinder unit articulatedly connected to the said angle lever.

This arrangement ensures in a simple manner that both the upper and the lower locking member may be engaged and disengaged completely synchronously at the same time by means of only a single hydraulic cylinder.

A further possibility of synchronous movement of the wedges lies, in a further development of the invention, in the wedges being provided with threaded bores into which engage threaded spindles driven by an electric or hydraulic motor by way of worm or bevel gearing, angle gearing and connecting shafts. In the case of this arrangement too, only a single drive is necessary for the synchronous movement of the two wedges.

In a further embodiment of the invention the locking members are arranged parallel to the axis of stretching with their end faces in each case in curved guides firmly secured to the counter gripping head, the common axis of curvature of the radii of the front and the rear curved surface being located in the region of the neutral axis of bending, running transversely to the axis of stretching, of the cross member of the counter gripping head. This prevents the counter gripping head in the case of bending deformation of the cross member or the curves in the case of slight skewing of the counter gripping head from exerting transverse forces upon the pressure elements guided in support frames. If the above-mentioned known double arrangement of locking pins disposed one behind the other is employed for locking the counter gripping head to the pressure elements, transverse forces of this type could not be avoided.

According to a further concept of the invention the tooth flanks of the toothing and the common axis of curvature of the curved faces are inclined by an angle $\alpha$ of 7° to 10° from the vertical to the axis of stretching. Owing to the inclination of the direction of the tooth flanks and the curved faces by 7° to 10°, the direction of the main stretching forces to be transmitted from the locking members is altered in such a way that no substantial force components act upon the wedges. The wedges would otherwise have to be made very strong.

BRIEF DESCRIPTION OF THE DRAWINGS

One example of the invention will now be explained in greater detail with reference to the accompanying drawings, wherein.

DETAILED DESCRIPTION

Figure 1:
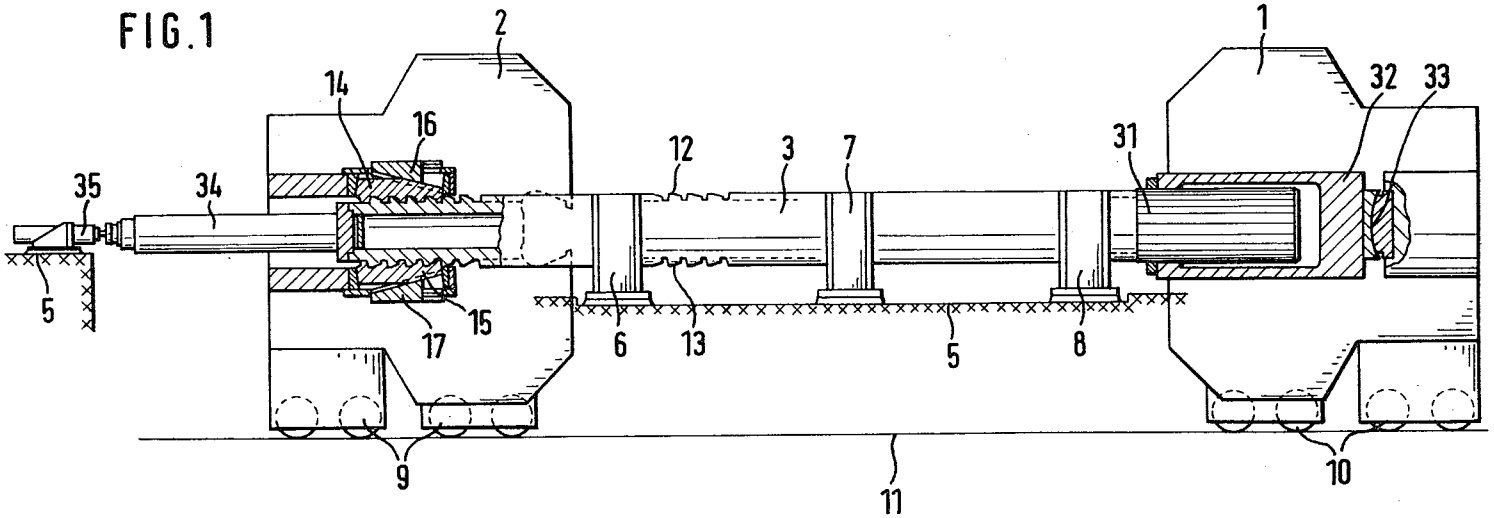
FIG. 1 is an elevational partly cross-sectional view of a sheet stretcher in accordance with the invention.
Figure 2:
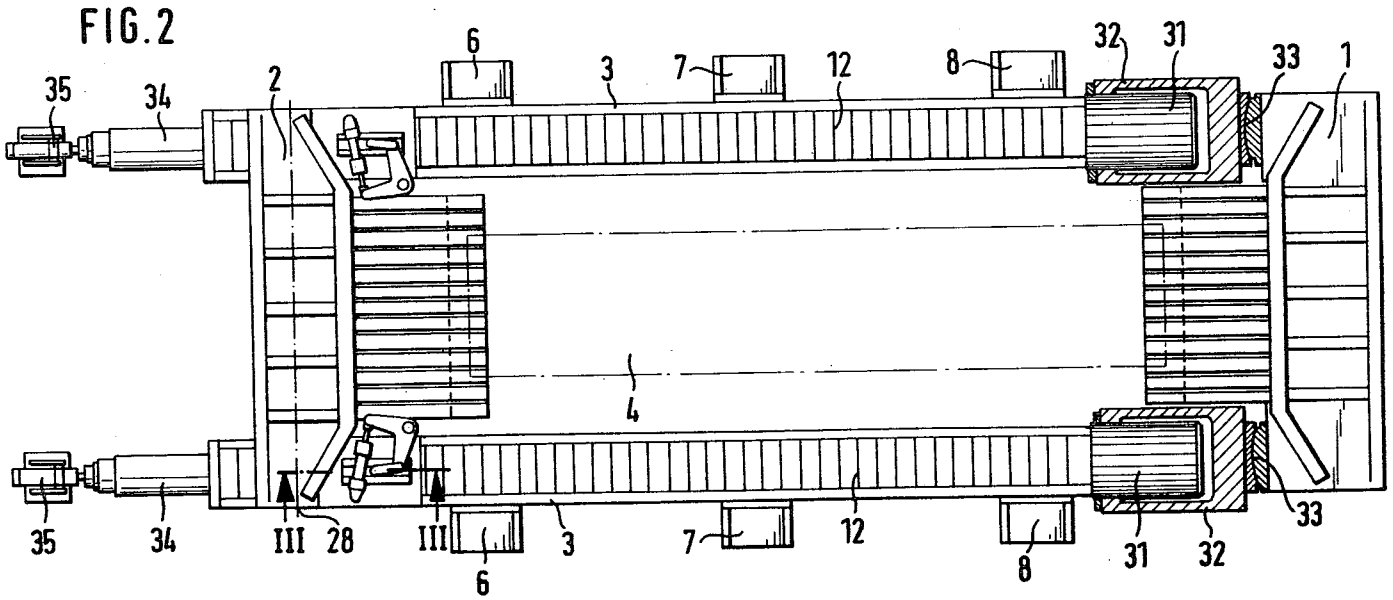
FIG. 2 is a top plan view partly in cross-section of the sheet stretcher.

A stretching gripping head 1 of a sheet stretcher is connected to a counter gripping head 2 by way of two pressure elements 3 which are formed as press rods with a rectangular cross-section and which are disposed in the plane of the axis of stretching on both sides and at the level of the material or sheet 4 to be stretched (shown in dash-dot lines in FIG. 2). In this arrangement the pressure elements 3 are guided slidingly in support frames 6 to 8 secured along their axis to a base plate 5. The counter gripping head 2 has driven rollers 9 and the stretching gripping head 1 has rollers 10 which are guided in a track 11 (FIGS. 1 and 2).

The top and underside of the part of the pressure elements 3 towards the counter gripping head 2 are provided with teeth 12 and 13. Locking members 14 and 15, which are provided with a plurality of corresponding teeth and are located and held in the counter gripping head 2, engage in the teeth 12 and 13. In this arrangement the teeth of the locking members 14 and 15 are engageable and disengageable with the teeth 12 and 13 of the pressure element 3 (FIG. 1).

Engagement and disengagement is effected by wedges 16 and 17 which are constructed as displacement wedges and slide horizontally in the longitudinal direction in guide plates 18 and 19 secured to the counter gripping head 2. The wedges 16, 17 slide in hammer-head grooves 20, 21 (FIG. 5) in the locking members 14, 15. In this way, as the wedges 16, 17 move longitudinally, the locking members 14, 15 are moved into and out of the teeth 12, 13 of the pressure elements 3.

Figure 4:
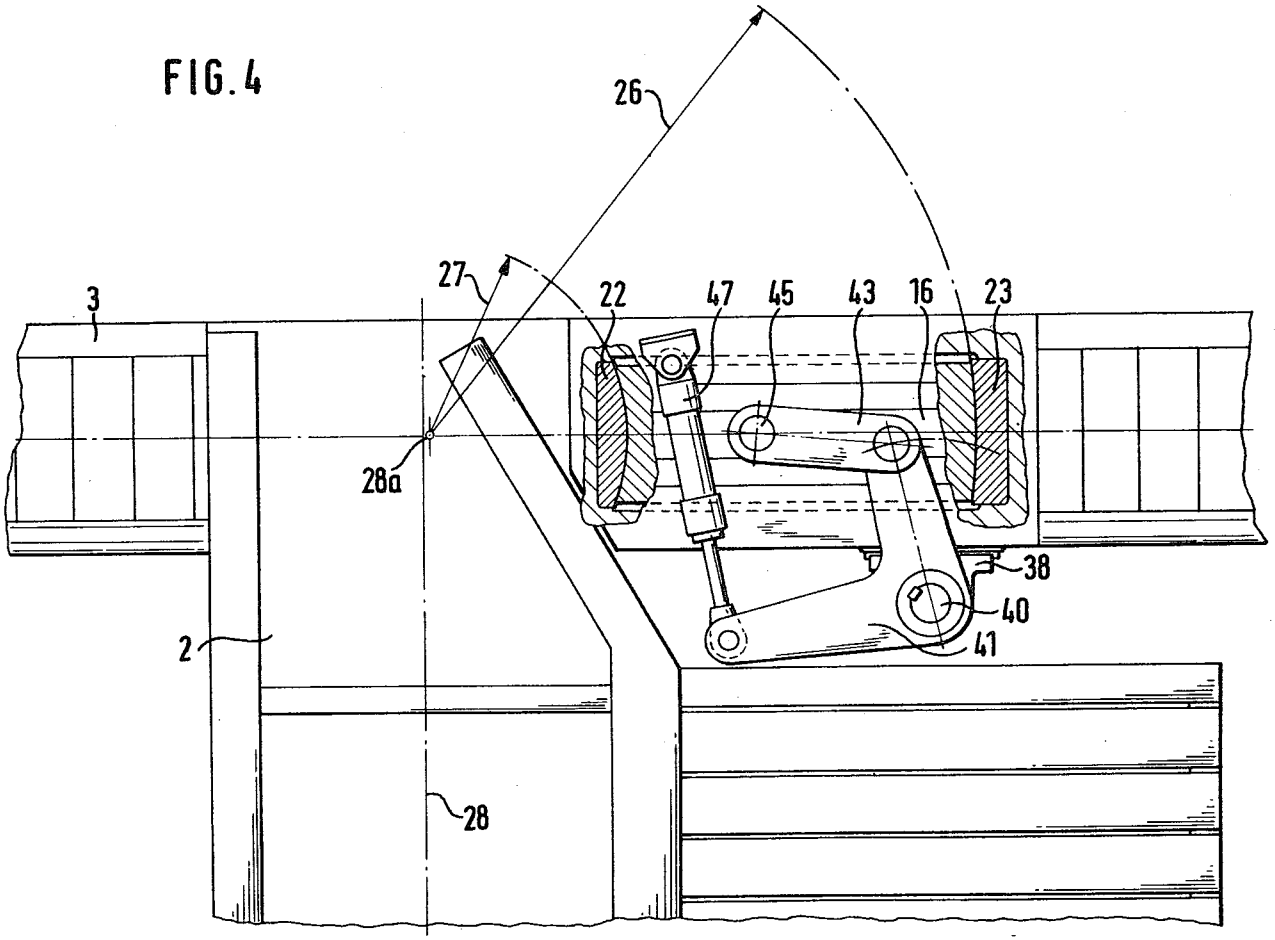
FIG. 4 is a top plan view of the locking means according to FIG. 3.

The force for stretching the sheet 4 is transmitted to the teeth of the locking members 14, 15 by way of the pressure elements 3 and their teeth 12, 13. A plurality of teeth may be used simultaneously for force transmission. The locking members 14, 15 are supported with their end faces on curved surfaces 22, 23 and 24, 25. The curved surfaces 22, 23 and 24, 25 are firmly secured in the counter gripping head 2. The curvature of each of the curved surfaces 22 to 25 is arranged in such a way that the common axis of curvature 28*a* of the radii 26 and 27 of the curved surfaces is located approximately in the neutral axis of bending 28 which runs transversely to the axis of stretching (FIG. 4). The curved surfaces are shown as cutaway portions in this top view in FIG. 4.

Figure 3:
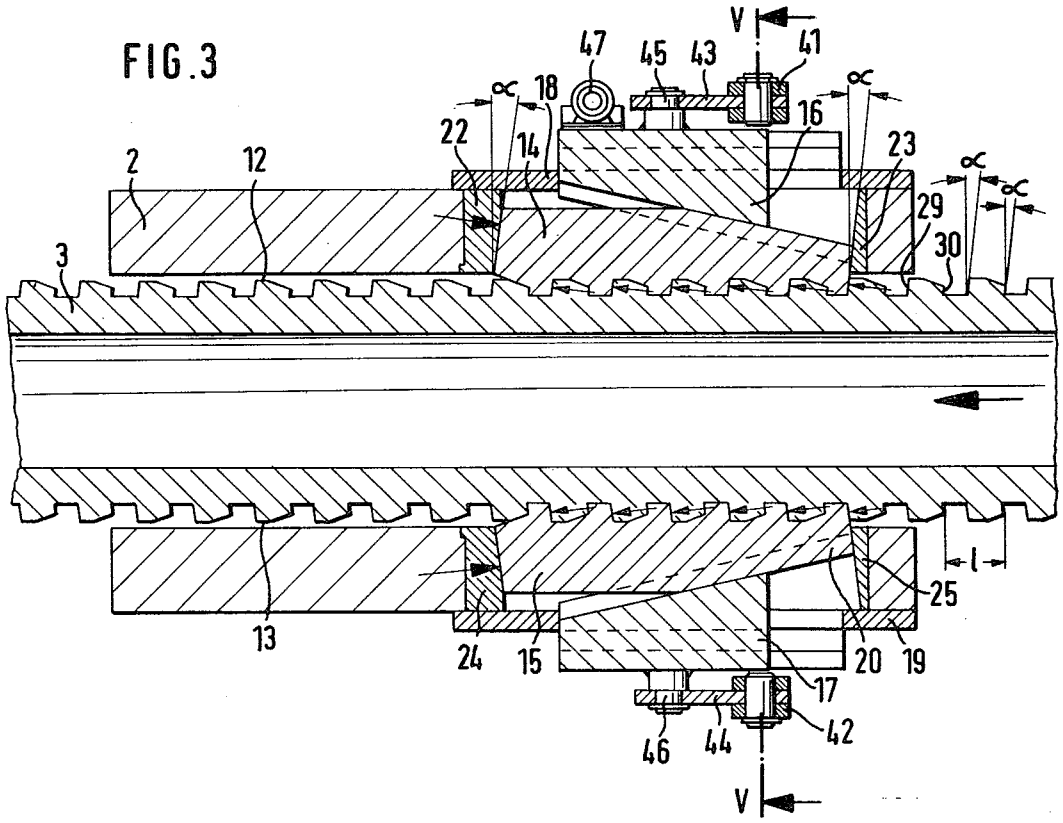
FIG. 3 is a cross-sectional view showing the locking means of the counter gripping head of the sheet stretcher and pressure elements on an enlarged scale taken along the line III—III of FIG. 2.

For the sake both of a small tooth pitch I and of the force characteristic of the parts transmitting the stretching force, the faces of the curved surfaces 22 to 25 and the tooth flanks 29, 30 are inclined by an angle $\alpha$ of 7° to 10° to the perpendicular to the axis of stretching (FIG. 3).

The front ends of the pressure elements 3 towards the stretching gripping head 1 are rigidly connected to stretching pistons 31. The latter slide in stretching cylinders 32, which are mounted in turn in the stretching gripping head 1. The stretching cylinders 32 are supported on the stretching gripping head 1 in conventional manner by spherical segments 33 (FIGS. 1 and 2).

The front ends of the pressure elements 3 towards the counter gripping head 2 are connected by way of press rods 34 to double-acting damping cylinders 35 secured to the base plate 5.

Figure 6:
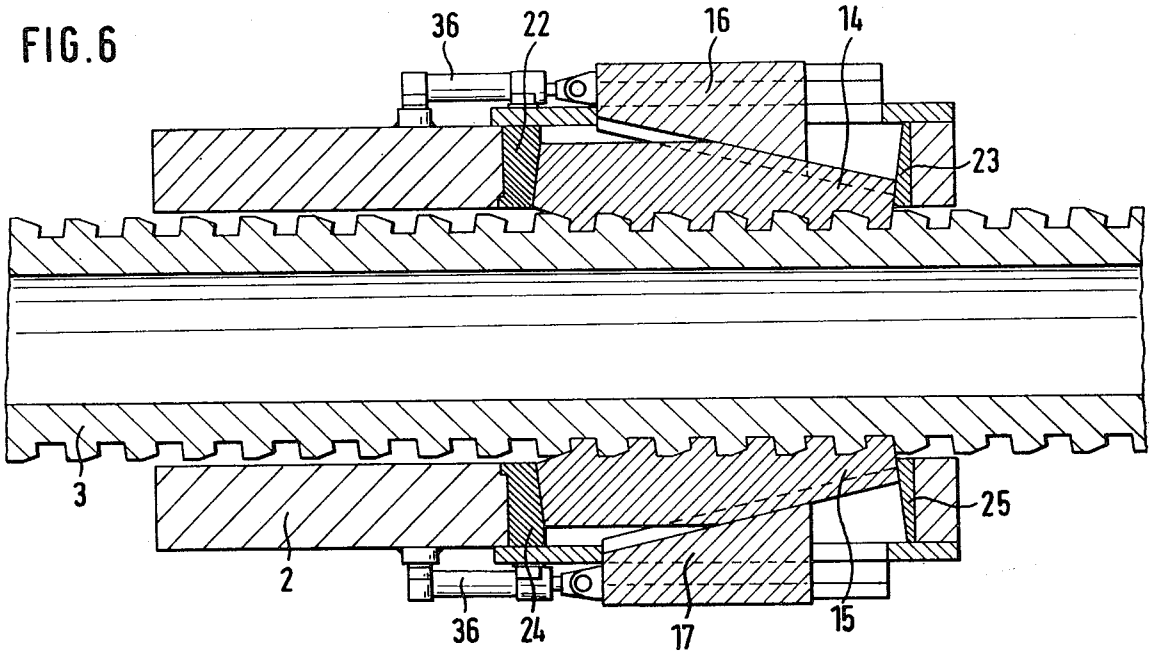
FIG. 6 is an enlarged cross-sectional view similar to FIG. 3 through the locking means of the counter gripping head showing an alternative solution of the wedge displacement.

The wedges 16, 17 may be axially displaced in a simple manner by hydraulic cylinder units 36 which are disposed on the counter gripping head 2, act parallel to the axis of stretching and are articulatedly connected to the wedges 16, 17 (FIG. 6).

Figure 5:
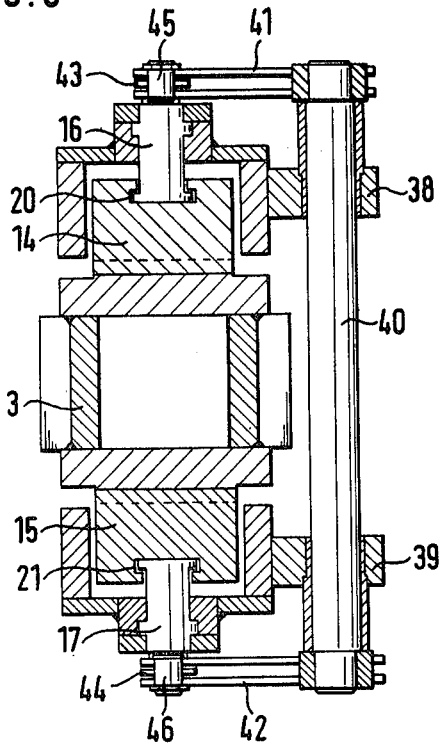
FIG. 5 is a cross-sectional view through the locking means taken along the line V—V of FIG. 3.

The displacement of the upper and lower wedge 16, 17 with only a single hydraulic displacement cylinder 47 is shown in FIGS. 3, 4 and 5. A vertically disposed shaft 40, to the upper end of which an angle lever 41 is rotationally rigidly connected, is rotatably mounted in bearing blocks 38 and 39 on the counter beam 2. At the lower end of the shaft 40 a simple arm 42 is rotationally rigidly mounted on the said shaft 40. Linking plates 43 and 44, which are rotatably mounted on journals 45 and 46 secured to the wedges 16, 17, are linked to one end of the angle lever 41 and the free end of the rotationally rigid arm 42. An hydraulic pivoting cylinder unit 47, which displaces the wedges 16, 17 by way of the angle lever 41, shaft 40 and linking plates 43, 44, is linked to the other free end of the angle lever 41.

Figure 7:
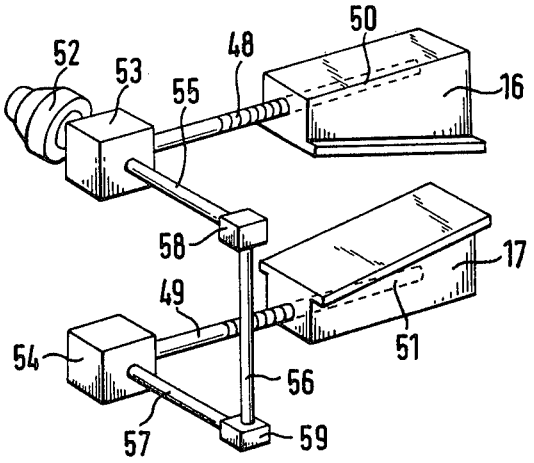
FIG. 7 is a schematic perspective view showing an alternative displacement mechanism for the wedges by means of synchromesh gearing, bevel gearing and threaded spindles.

FIG. 7 is a diagrammatic view of an embodiment in which the wedges 16 and 17 are displaced by threaded spindles 48 and 49, and corresponding threaded bores 50, 51, into which the threaded spindles 48, 49 engage, are provided in the wedges 16, 17. The drive is provided by an electric or hydraulic motor 52, by way of worm or bevel gearing 53, 54, shafts 55, 56 and 57 and bevel gearing 58 and 59.

I claim:

1. In apparatus for stretching metal sheet or sections comprising a movable gripping head adapted to grip a first end of a sheet or section to be stretched, a counter gripping head facing and spaced from the movable gripping head and adapted to grip a second end of the sheet or section to be stretched, elongate pressure elements extending from the counter gripping head towards the movable gripping head level with and on respective opposite sides of the sheet or section to be stretched, and means for moving the movable gripping head away from the counter gripping head for stretching the said sheet or section thereby generating compression stresses in the pressure elements, the improvement comprising, each pressure element has a substantially rectangular peripheral cross-sectional shape, an upper surface and a lower surface on each pressure element, a series of teeth on said surfaces extending along each pressure element, respective upper and lower locking members for each pressure element adjustably mounted in the counter gripping head, a series of teeth on each locking member extending longitudinally relative to the pressure element and corresponding to and engageable with said teeth on each respective pressure element and arranged to mesh therewith, and means for moving said locking members into and out of mesh with said teeth on said pressure elements.

2. In apparatus for stretching metal sheet or sections comprising a movable gripping head adapted to grip a first end of a sheet or section to be stretched, a counter gripping head facing and spaced from the movable gripping head and adapted to grip a second end of the sheet or section to be stretched, elongate pressure elements extending from the counter gripping head towards the movable gripping head level with and on respective opposite sides of the sheet or section to be stretched, and means for moving the movable gripping head away from the counter gripping head for stretching the said sheet or section thereby generating compression stresses in the pressure elements, the improvement comprising, each pressure element has a substantially rectangular peripheral cross-sectional shape, an upper surface and a lower surface on each pressure element, a series of teeth on said surfaces extending along each pressure element, respective upper and lower locking members for each pressure element adjustably mounted in the counter gripping head, a plurality of teeth on each locking member corresponding to and engageable with said teeth on each respective pressure element arranged to mesh therewith, respective wedges slidably mounted in said counter gripping head for movement substantially in the axial direction of the elongate pressure elements, guide means interconnecting said wedges and locking members, and means for moving said wedges to move said locking members into and out of mesh with said teeth on said pressure elements.

3. Apparatus as defined in claim 2, wherein said means for moving said wedges comprises hydraulic cylinder and piston units mounted on the counter gripping head to act parallel said axial direction, and means to articulately connect said cylinder and piston units to said wedges.

4. Apparatus as defined in claim 2 wherein said means for moving said wedges comprises for each pressure element, a vertical shaft rotatably mounted on the counter gripping head, levers non-rotatably mounted on said shaft, links pivotally connected to said levers and to respective wedges, and a single hydraulic cylinder piston unit operatively articulated between the counter gripping head and one of said levers.

5. Apparatus as defined in claim 2 wherein said means for moving said wedges comprises screw-threaded bores provided in the wedges, screw-threaded spindles threadedly engaging in said bores, and driving means for rotating said spindles.

6. Apparatus as defined in claim 5 wherein said driving means comprises common driving means operatively associated respectively with each pressure element including reduction gearing means and angular gearing means forming power transmission paths from said common driving means to the respective spindles.

7. Apparatus as defined in claim 2 wherein said teeth have flanks which are substantially perpendicular to the axis of stretching.

8. Apparatus as defined in claim 2 wherein each pressure element comprises a hollow rectangular member.

9. In apparatus for stretching metal sheet or sections comprising a movable gripping head adapted to grip a first end of a sheet or section to be stretched, a counter gripping head facing and spaced from the movable gripping head and adapted to grip a second end of the sheet or section to be stretched, elongate pressure elements extending from the counter gripping head towards the movable gripping head level with and on respective opposite sides of the sheet or section to be stretched, and means for moving the movable gripping head away from the counter gripping head for stretching the said sheet or section thereby generating compression stresses in the pressure elements, the improvement comprising, each pressure element has a substantially rectangular peripheral cross-sectional shape, an upper surface and a lower surface on each pressure element, a series of teeth on said surfaces extending along each pressure element, respective upper and lower locking members for each pressure element adjustably mounted in the counter gripping head and arranged parallel to the axial direction of the elongate pressure elements, each locking member having opposite ends with respective curved end faces facing towards and away from the movable gripping head, curved guides mounted in the counter gripping head abutting respective ones of said end faces, curved guide surfaces on said curved guides, said curved end faces and guide surfaces having a common axis of curvature, a plurality of teeth on each locking member corresponding to and engageable with said teeth on each respective pressure element arranged to mesh therewith, means for moving said locking members into and out of mesh with said teeth on said pressure elements, and said counter gripping head comprises a cross member which has a neutral axis of bending extending transversely to the axis of stretching, said axis of curvature being disposed close to said neutral axis.

10. Apparatus as defined in claim 9 wherein the faces of curved surfaces and the flanks of said teeth are inclined at an angle of about 7° to 10° relative to the direction perpendicular to the axis of stretching.

* * * * *